US006116895A

United States Patent [19]

Onuschak

[11] Patent Number: 6,116,895

[45] Date of Patent: Sep. 12, 2000

[54] DUAL MODE CONVECTION OVEN

[75] Inventor: Anthony D. Onuschak, Dayton, N.J.

[73] Assignee: McNeil-PPC, Inc., Skillman, N.J.

[21] Appl. No.: 08/751,278

[22] Filed: Nov. 18, 1996

Related U.S. Application Data

[63] Continuation of application No. 08/403,163, Mar. 10, 1995.

[51] Int. Cl.[7] ..... F27B 9/28

[52] U.S. Cl. ..... 432/59; 432/8; 432/48; 432/72; 432/120

[58] Field of Search ..... 432/59, 72, 8, 432/48, 120, 121, 128; 34/78, 477

[56] References Cited

U.S. PATENT DOCUMENTS

| | | | |
|---|---|---|---|
| 3,941,557 | 3/1976 | Buchner | 432/17 |
| 4,115,052 | 9/1978 | Flynn | 432/72 |
| 4,590,916 | 5/1986 | Konig | 126/21 |
| 4,767,320 | 8/1988 | Sasaki et al. | 432/59 |

FOREIGN PATENT DOCUMENTS

| | | |
|---|---|---|
| 0 472 906A2 | 3/1992 | European Pat. Off. . |
| 2 234 421A | 2/1991 | United Kingdom . |

*Primary Examiner*—Denise L. Ferensic
*Assistant Examiner*—Jiping Lu

[57] ABSTRACT

A method and apparatus for selectively providing convective heat to an object with a dual mode convection oven that is alternatively operable in either a running mode or a bypass mode. Convective heat is channelled into a supply hood through a supply duct. Convective heat is also channelled out of a suction hood through a return duct. An operating mode for the convection oven is selected. If the selected operating mode is the running mode, then convective heat is applied to the object by channelling the convective heat from the supply hood through a heat application zone and into the suction hood, the heat application zone being positioned between the supply hood and the suction hood. If the selected operating mode is the bypass mode, then convective heat is channelled away from the heat application zone by directing the convective heat from the supply hood through a bypass duct and into the suction hood, the bypass duct having a first end coupled to the supply hood and a second end coupled to the suction hood.

19 Claims, 8 Drawing Sheets

DUAL MODE CONVECTION OVEN

This is a continuation of application Ser. No. 08/403,163, filed Mar. 10, 1995.

FIELD OF THE INVENTION

The present invention relates generally to systems for providing convective heat transfer to objects. More particularly, the present invention relates to hot air ovens used for heating a substantially continuous supply of nonwoven materials. Still more particularly, the present invention relates to hot air ovens which are part of a manufacturing line that is routinely stopped and started.

BACKGROUND OF THE INVENTION

During the manufacture of products made of nonwoven fibers, it is typically necessary to bond the nonwoven fibers through the application of heat. After the fibers have been bonded, they are typically used thereafter to form many types of products including, for example, personal care products such as sanitary napkins, incontinence pads, diapers, absorbent bed pads, and the like. The process of heating the nonwoven fibers is typically performed with a convection oven as an early step in a continuous manufacturing process that begins with the bonding of the nonwoven fibers and ends with the production of a final product formed from the bonded fibers. The continuous manufacturing process typically involves multiple machines which operate sequentially on a single continuously moving web of nonwoven fibers.

The convection oven used for bonding the continuously moving web of nonwoven fibers typically includes a conveyor mechanism for continuously carrying the nonwoven fiber web through the interior of the oven. As the web moves through the oven, the speed of the conveyor and oven temperature are such that the web is exposed to the appropriate amount of heat necessary for bonding as the web travels through the interior length of the oven. If, for any reason, the temperature inside the oven is too low as the web travels through the oven, the web will be exposed to insufficient heat and will not be properly bonded. In addition, if, for any reason, the web were to stop for any length of time within the oven, the web may be overexposed to heat resulting in overbonding, overdrying and/or burning. Product that is not processed to specifications, e.g., overbonded or underbonded, can affect the efficiency of downstream processes. For example, an overbonded core in a sanitary napkin manufacturing line may be too stiff to fold, and an underbonded absorbent core may be too bulky or weak to handle. These problems increase waste levels and decrease manufacturing efficiencies.

During the continuous manufacturing process described above, machines in the manufacturing line other than the oven used for bonding the web may require stoppage of the manufacturing line. When such a stoppage occurs, the portion of the web residing inside the convection oven will also stop. In order to avoid any overprocessing of the web material that has stopped inside the oven, the flow of heat inside the oven directed onto the web must either cease or be diverted away from the web when the manufacturing line stops. However, in order to ensure that, upon restarting of the manufacturing line, the portion of the web exiting the oven will be sufficiently bonded, the oven must be maintained in a hot state such that little or no time transpires between the time the manufacturing line is switched back on and the time the oven reaches its appropriate operating temperature.

Several bypassing systems have been proposed for diverting the flow of heat inside an oven away from a continuous product line. Two such systems are shown in U.S. Pat. No. 4,590,916 by Konig and U.K. Patent Application No. GB 2234421A by Norfolk, both of which are directed to baking ovens. In these systems, the ovens may operate in either a running mode or a bypass mode. During the running mode, hot air circulates through a cooking zone in the oven containing food items thereby impinging on the items being baked. In the bypass mode, hot air continues to circulate in the oven, however, the recirculation path is such that the air flow within the oven is diverted around the cooking zone.

The prior art systems identified above are unsatisfactory for a continuous manufacturing line such as the one described above for forming personal products, because the response time required to bring the oven out of bypass mode and into its running mode is lengthy. A major cause of these lengthy response times stems from the relationship between the respective air flow paths used in these prior systems during their running and bypass modes. More particularly, in these prior art systems, a large portion of the ductwork used during the running mode is not used during the bypass mode. Since this unused ductwork has no hot air flow during the bypass mode, it cools down when the oven remains in the bypass mode. Upon restarting of the running mode, this unused ductwork acts as a heat sink for the hot air circulating in these systems and, as a result, these systems may not reach an appropriate operating temperature until the ductwork that was unused during the bypass mode has been warmed up to a satisfactory point.

It is an object of the present invention to provide a convection oven that can be used as part of a substantially continuous manufacturing line.

It is a further object of the present invention to provide a convection oven that can be switched between a running mode and a bypass mode, and which has a fast response time when switched out of a bypass mode and back to a running mode.

It is a still further object of the present invention to provide a convection oven that can be used for heating a substantially continuous supply of nonwoven fibers, which system allows for stoppage of the supply within the oven and which, upon restarting of the supply, outputs fibers that are properly processed.

These and still other objects of the invention will become apparent upon study of the accompanying drawings and description of the invention.

SUMMARY OF THE INVENTION

The invention relates to a method and apparatus for selectively applying convective heat to an object with a dual mode convection oven that is alternatively operable in either a running mode or a bypass mode. Convective heat is channelled into a supply hood through a supply duct. Convective heat is also channelled out of a suction hood through a return duct. An operating mode for the convection oven is selected. If the selected operating mode is the running mode, then convective heat is applied to the object by channelling the convective heat from the supply hood through a heat application zone and into the suction hood, the heat application zone being positioned between the supply hood and the suction hood. If the selected operating mode is the bypass mode, then convective heat is channelled away from the heat application zone by directing the convective heat from the supply hood through a bypass duct and into the suction hood, the bypass duct having a first end coupled to the supply hood and a second end coupled to the suction hood.

DETAILED DESCRIPTION OF THE PREFERRED EMBODIMENT

Figure 1:
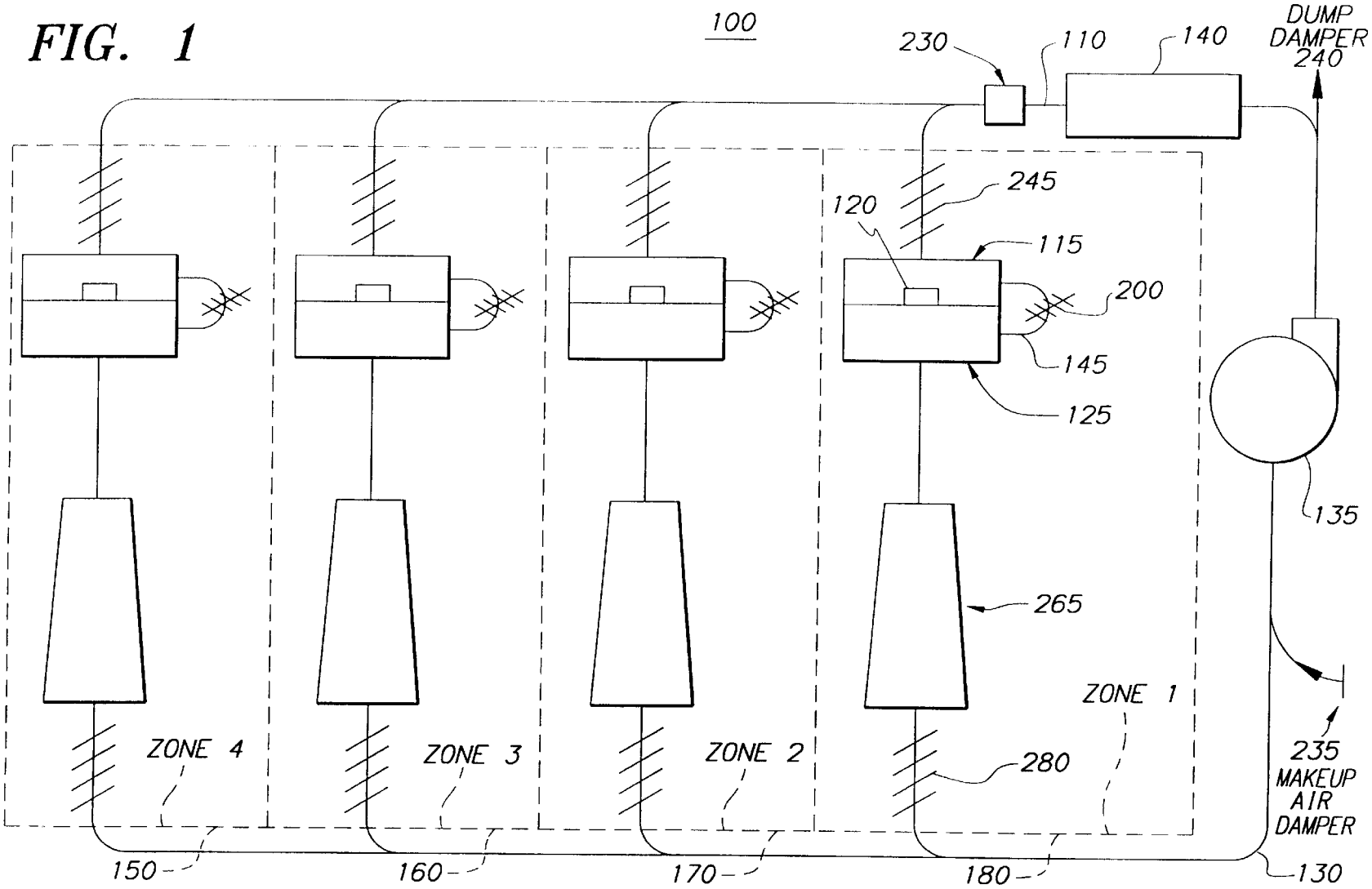
FIG. 1 is a block diagram showing the operation of a convection oven system in accordance with a preferred embodiment of the present invention.

Referring now to FIG. 1, there is shown a block diagram illustrating the operation of a convection oven system 100 in accordance with a preferred embodiment of the present invention. Convection oven system 100 is alternately operable in either a running mode or a bypass mode. By way of an overview, in the running mode, hot air from supply duct 110 is provided to a supply hood 115. Hot air from the supply hood 115 is then circulated downwardly so as to impinge on an object 120. Preferably, object 120 is a porous mass of nonwoven fibers. This mass of fibers may be a continuous web or a supply of discrete shaped fibrous pieces. As hot air passes over and/or through object 120, it is drawn into suction hood 125. A return duct 130 channels hot air out of suction hood 125. Circulating fan 135 circulates hot air from return duct 130, through heater 140, and back to supply duct 110. When convection oven system 100 is switched from its running mode to its bypass mode, all hot air entering supply hood 115 is channelled directly from supply hood 115 to suction hood 125 through bypass duct 145. In the bypass mode, the hot air supplied into supply hood 115 from supply duct 110 is channelled away from and around object 120, and therefore does not impinge on object 120 in the bypass mode.

As explained more fully below, convection oven system 100 is preferably a multi-zone oven system formed of four separate oven zones 150, 160, 170 and 180 arranged in series. As shown in FIG. 1, zones 150, 160, 170 and 180 have substantially identical components. During the operation of system 100 in its running mode, an object 120, such as a continuous web of nonwoven fibers is preferably carried sequentially through each of the four oven zones.

Figure 2:
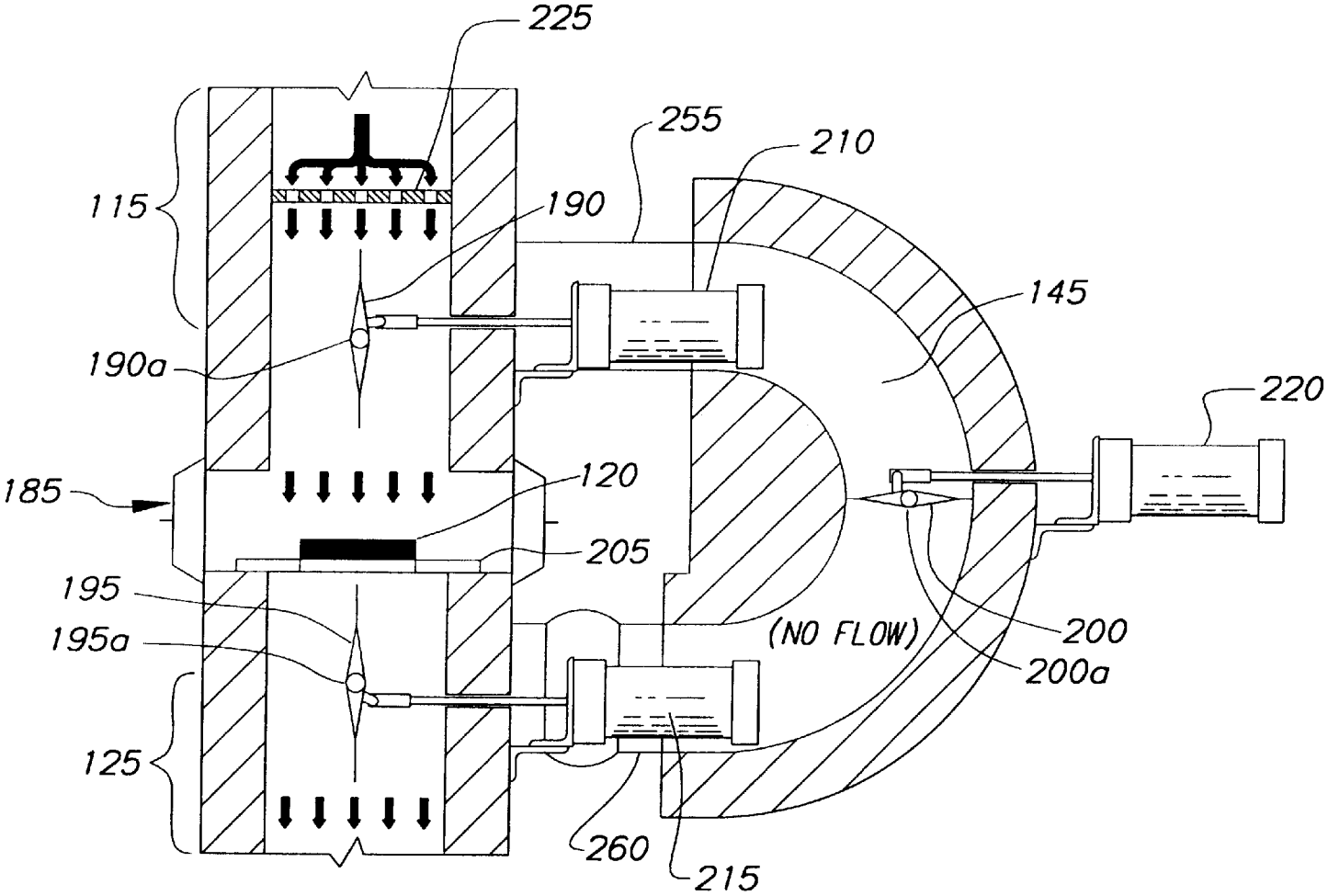
FIG. 2 is a cut-away view of a convection oven in a running mode in accordance with a preferred embodiment of the present invention.

Referring now to FIG. 2, there is shown a cut-away view of convection oven system 100 configured in its running mode in accordance with a preferred embodiment of the present invention. A bypass supply damper 190 is positioned at the lower end of supply hood 115, and a bypass suction damper 195 is positioned at the upper end of suction hood 125. A heat application zone 185 is positioned between supply hood 115 and suction hood 125 for applying hot air flowing in the direction of the arrows shown to object 120. Object 120 is preferably carried through the heat application zone 185 in a substantially continuous motion during the running mode by conveyor assembly 205. A bypass duct damper 200 is positioned within bypass duct 145. Dampers 190, 195 and 200 are pivotally mounted within convection oven system 100 at pivot points 190a, 195a, and 200a, respectively. The angular positions of dampers 190, 195 and 200 are respectively controlled by mechanical actuators 210, 215 and 220. During the running mode, mechanical actuators 210 and 215 maintain bypass supply damper 190 and bypass suction damper 195 in an open position, and mechanical actuator 220 maintains bypass duct damper 200 in a closed position. Thus, as shown by the arrows in FIG. 2, during the running mode, hot air flows from supply hood 115, through heat application zone 185 and into suction hood 125. Significantly, during the running mode, essentially no hot air flows through bypass duct 145. In order to facilitate the even flow of hot air through the heat application zone 185 in the running mode, a flow distributor, e.g., a perforated plate 225 is preferably provided within supply hood 115 for dispersing the hot air exiting supply hood 115.

Figure 3:
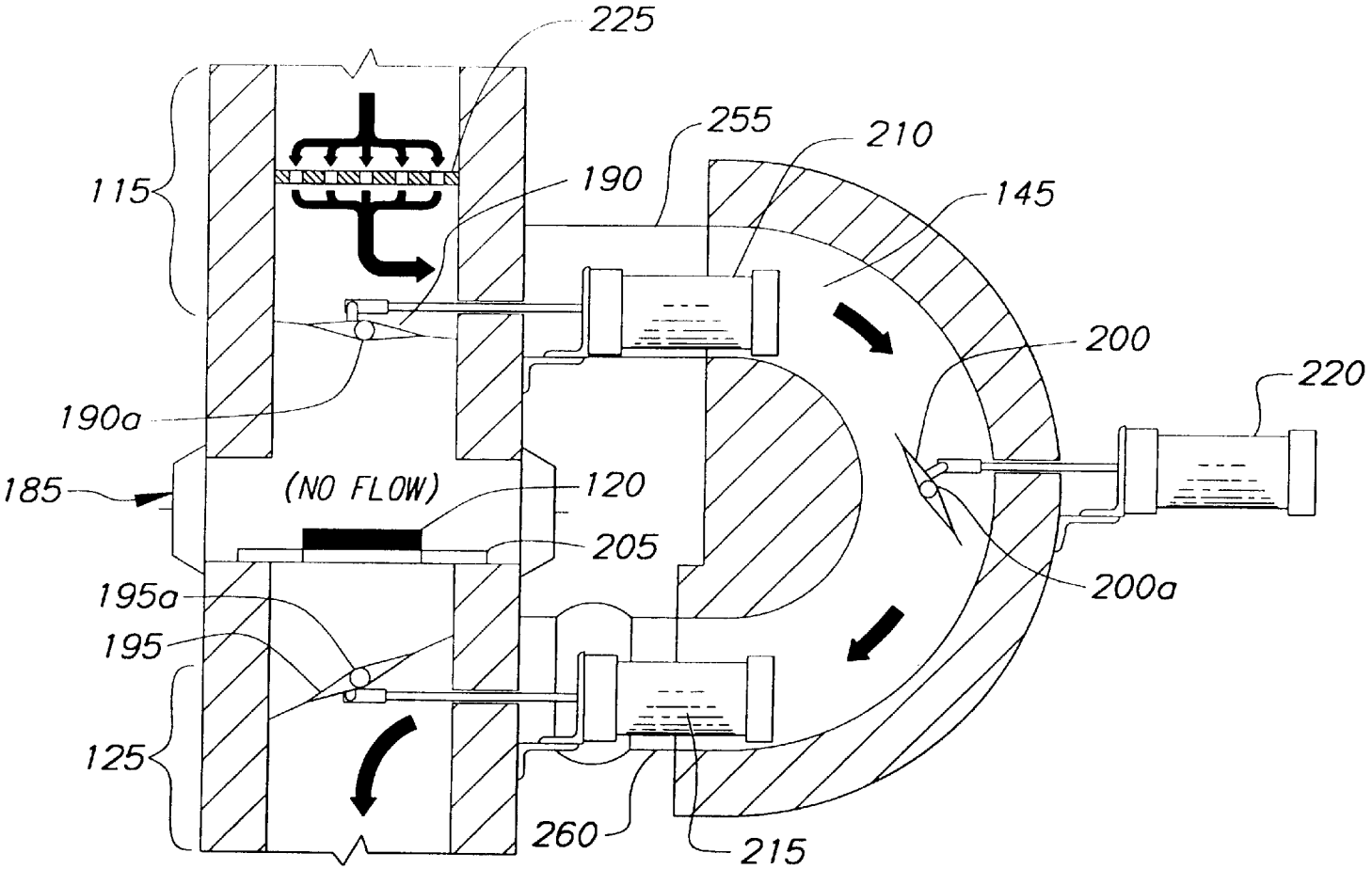
FIG. 3 is a cut-away view of a convection oven in a bypass mode in accordance with a preferred embodiment of the present invention.

Referring now to FIG. 3, there is shown a cut-away view of convection oven system 100 configured in its bypass mode in accordance with a preferred embodiment of the present invention. When the present invention is switched from its running mode to its bypass mode, mechanical actuators 210 and 215 switch bypass supply damper 190 and bypass suction damper 195 to their closed positions, and mechanical actuator 220 switches bypass duct damper 200 to its open position. Thus, as shown by the arrows in FIG. 3, during the bypass mode, hot air flows from supply hood 115, through bypass duct 145 and into suction hood 125. In the bypass mode, hot air flows from supply hood 115 into bypass duct 145 by passing through bypass supply duct 255, and hot air flows from bypass duct 145 back into suction hood 125 by passing through bypass return duct 260. Significantly, during the bypass mode, essentially no hot air flows through heat application zone 185 or over object 120. In the bypass mode, conveyor assembly 205 is preferably stopped and object 120 therefore remains in a fixed position within heat application zone 185.

As indicated above, it is desirable to minimize the volume and surface area in the heat application zone 185 which may change temperature during the bypass mode and become a heat sink when the system returns to the running mode. Therefore, in a preferred embodiment, such as illustrated in FIGS. 2–7, the heat application zone 185 represents about 25% or less of the total oven hood volume which includes the heat application zone 185, supply hood 115, and suction hood 125. In addition, in this preferred embodiment, the perforated plate 225 is located in the supply hood 115 to minimize surface area in the heat application zone 185. Thus, the heat application zone 185 which is not directly heated in the bypass mode occupies only a very small proportion of the air circulation volume. In addition, during the bypass mode, there is a significant amount of thermal conduction from the bypass duct 145 to the heat application zone 185 which keeps this zone nearer to the operating temperature without overheating object 120. In contrast, external bypass systems have increased bypass duct surface area and reduced thermal conduction back to the heat application zone. These factors are helpful to limit the response time when returning to the running mode from the bypass mode.

In the preferred embodiment of the present invention, the hot air flowing through heat application zone 185 is maintained at a substantially constant level during the running mode of system 100. When system 100 is used for bonding nonwoven fibers, temperatures in the range of about 100° F.–350° F. may be used. Preferably, when used to bond fusible polyethylene fibers, the target temperature of the hot air flowing through heat application zone 185 is 270–280° F. In order to maintain this temperature level during the running mode, temperature sensor 230 monitors the temperature of the hot air exiting heater 140. In response to the sensed temperature of air exiting heater 140, the heat energy supplied to the air passing through heater 140 is adjusted by varying the rate at which is energy is supplied to heater 140. Heater 140 is preferably either a gas fired or electric heater, and the rate at which energy is supplied to heater 140 may therefore be varied by adjusting the firing rate of the gas (for a gas heater) or the electric current (for an electric heater) provided to heater 140.

During the running mode, the heat energy imparted to the hot air flowing through heater 140 is used to replace, among other things, the heat energy absorbed by object 120 as it passes through heat application zone 185. When the present invention is switched from its running mode to its bypass mode, the firing rate of the heater 140 is fixed at a constant level which is substantially equivalent to the firing rate used during the running mode. While in the bypass mode, this firing rate is maintained at this fixed level and is preferably not varied. Thus, in the bypass mode, heat energy is continually added to the air circulating through the system at substantially the same rate as such energy was added during the running mode, however, in contrast to the running mode, no heat energy is absorbed from the air circulating through the system by object 120 in the bypass mode. In order to compensate for the lack of heat energy absorbed by object 120 during the bypass mode, cool ambient air is pulled into the system through makeup air damper 235 during the bypass mode. More particularly, in the bypass mode, temperature sensor 230 monitors the temperature of the hot air exiting heater 140. In response to this sensed temperature, the volume of ambient air supplied into the system through makeup damper 235 is adjusted so that the temperature of the hot air exiting heater 140 is maintained at a constant level that is equivalent to the temperature level maintained during the running mode for air exiting heater 140, e.g., 270–280 degrees F. In order to maintain a constant pressure of air circulating within system 100, a portion of the air circulating within the system is expelled through dump damper 240 to compensate for the ambient air pulled into the system by makeup damper 235.

In the preferred embodiment of the present invention, object 120 and conveyor assembly 205 are porous to the hot air circulating through heat application zone 185. Thus, during the running mode, the hot air flowing through heat application zone 185 must pass through and/or around object 120 and conveyor 205. The resistance to the flowing air created by object 120 and conveyor assembly 205 results in a drop in air pressure across heat application zone 185 in the running mode. More particularly, in the running mode, the pressure of hot air impinging on object 120 and conveyor assembly 205 from supply hood 115 is higher than that of the hot air drawn into suction hood 125. In the preferred embodiment of the present invention, bypass duct damper 200 is angled during the bypass mode (as shown in FIG. 3) so as to simulate the pressure drop that is normally created across heat application zone 185 during the running mode. Thus, regardless of whether the system is operating in its running mode or its bypass mode, the change in air pressure between the hot air in supply hood 115 and that in suction hood 125 is substantially identical. In an alternate embodiment, an orifice plate (not shown) could be used in conjunction with bypass duct damper 200 to simulate the pressure drop that is normally created across heat application zone 185 during the running mode.

Figure 4:
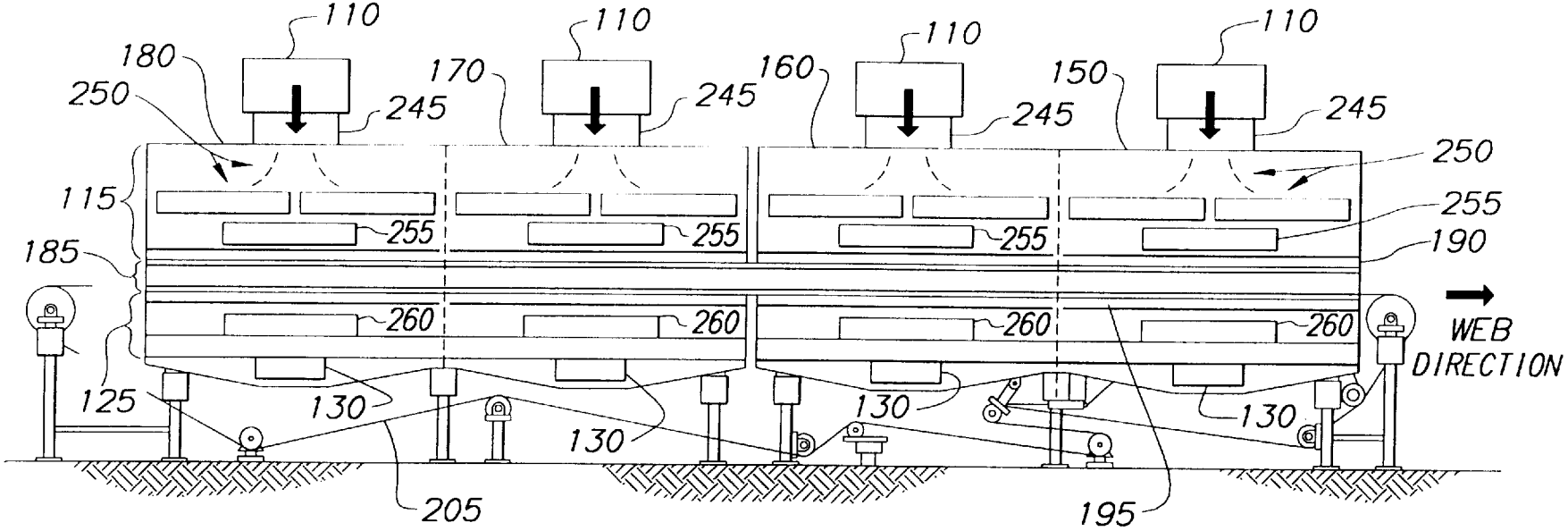
FIG. 4 is a schematic diagram showing further details of a convection oven system in accordance with a preferred embodiment of the present invention.

Referring now to FIG. 4, there is shown a schematic diagram illustrating a cut-away view of a convection oven system 100 in accordance with a preferred embodiment of the present invention. As shown in FIG. 4, a supply duct damper 245 controls the flow of hot air into each supply hood 115. In the preferred embodiment, the hot air entering supply hoods 115 through supply duct dampers 245 is dispersed throughout the length of each zone 150, 160, 170, 180 by vanes 250 positioned within each zone. The function of vanes 250 is to create an even air flow through each supply hood 115 during the running mode, and to ensure that the entire internal portion of each supply hood 115 remains hot in both the running and bypass modes. Similarly, vanes (not shown) may be used to disperse air flow in the suction hoods 125.

Figure 5:
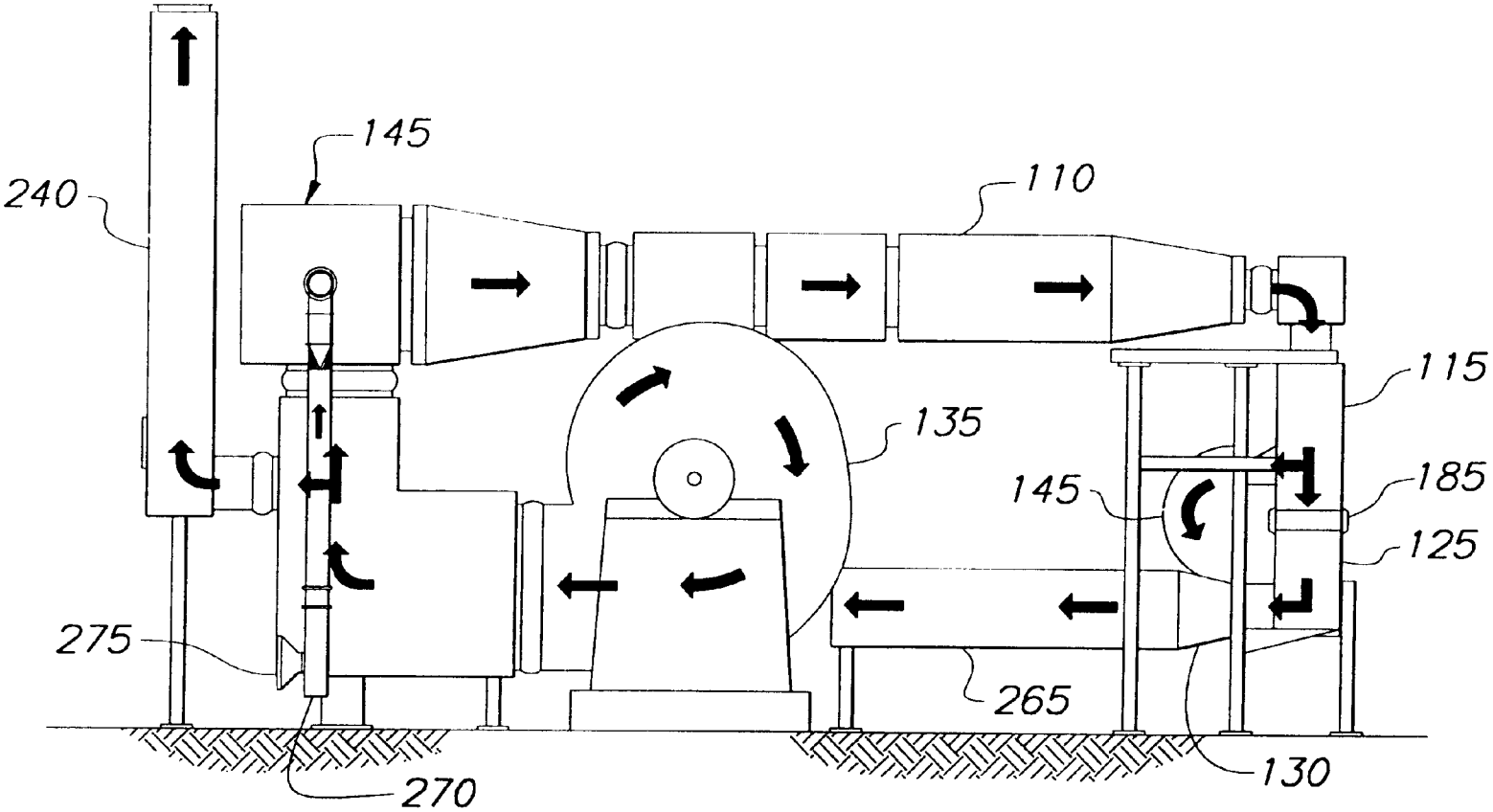
FIG. 5 is a schematic diagram showing the air circulation and air heating means used in conjunction with a preferred embodiment of the present invention.

Referring now to FIG. 5, there is shown a schematic diagram illustrating the air circulation and air heating means used in conjunction with a preferred embodiment of the present invention. In the preferred embodiment, air recirculating means 135 turns at the same fan speed regardless of whether system 100 is operating in its running mode or bypass mode. When air recirculating means 135 is used in conjunction with a four zone oven such as that shown in FIGS. 1 and 4 for bonding nonwoven fibers, air recirculating means 135 should move approximately 800 pounds of air per minute. Thus, when system 100 is operating in its running mode, air recirculating means 135 will move approximately 200 pounds of air per minute across each of the four heat application zones 185 in the four zone oven system. A venturi 265 is positioned in the air recirculation loop and measures the mass flow rate of the air exiting each suction hood 125. This mass flow rate is sensed by monitoring the change in air pressure across venturi 265. In response to the mass flow rate sensed by venturi 265, an exhaust damper 280 regulates the volume of air flowing out of each zone 150, 160, 170 and 180 and into air recirculating means 135. In the preferred embodiment, each exhaust damper 280 regulates the mass flow rate of air exiting a suction hood 125 so as to maintain it at a constant rate of 200 pounds of air per minute.

As shown in FIG. 5, dump damper 240 is positioned between air recirculating means 135 and heater 145. In order to prevent the build-up of excess moisture in the air circulating through system 100, during the running mode approximately 10% of the air exiting the air recirculating means 135 is dumped before reaching heater 145. The volume of air dumped through dump damper 240 in the running mode is replaced by adding a corresponding volume of ambient air into the system through makeup air damper 235, which is shown in FIG. 7.

As mentioned above, heater 145 may alternatively be either a gas fired or electric heater. In FIG. 5, heater 145 is shown as a gas fired heater. A gas supply line 270 provides gas to heater 145 through adjustable valve 275. During the running mode, adjustable valve 275 regulates the rate at which gas is provided to heater 145 in response to the temperature measured by temperature sensor 230. During the bypass mode, adjustable valve 275 provides gas to heater 145 at a preset fixed rate.

Figure 6:
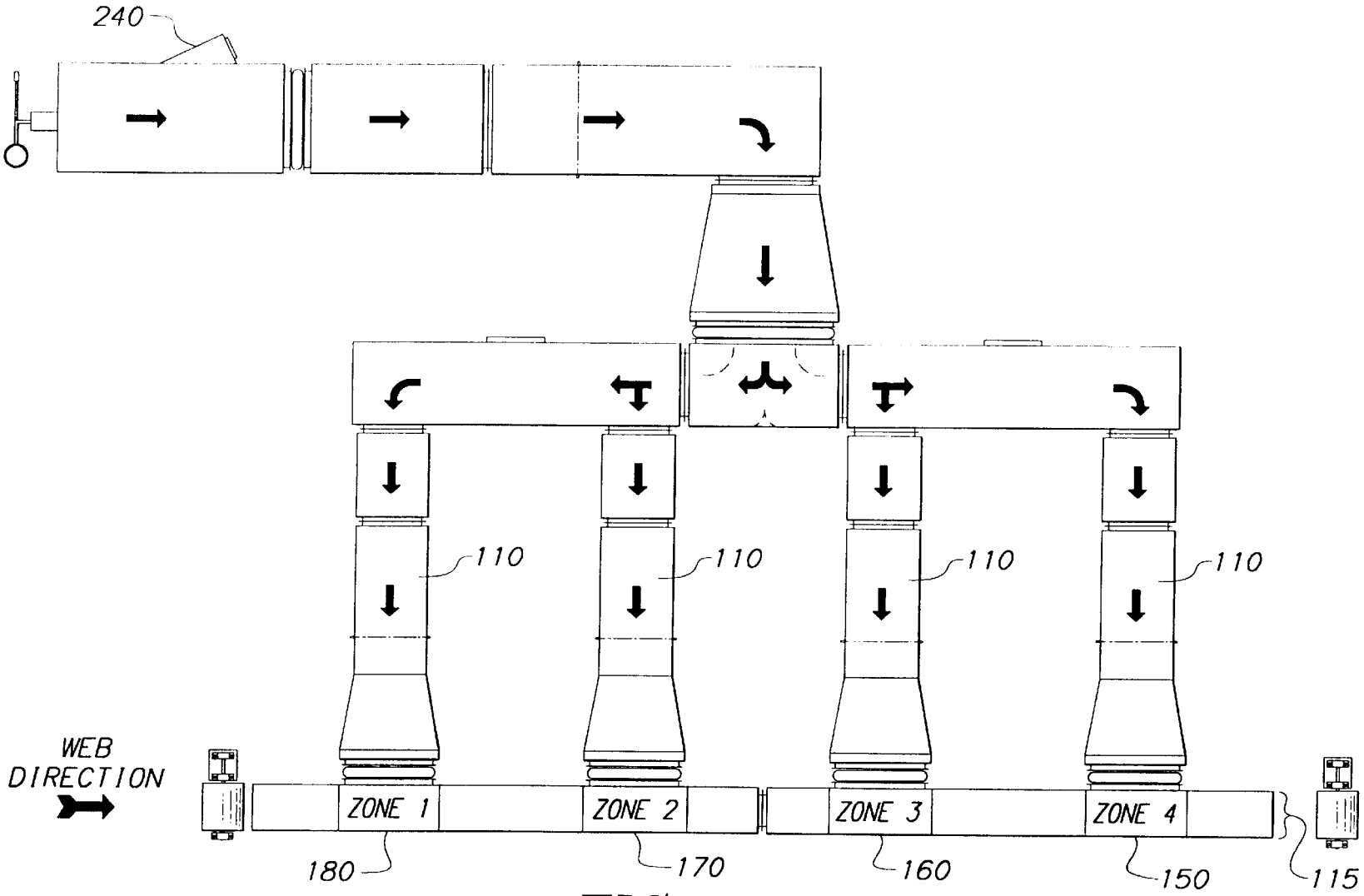
FIG. 6 is a schematic diagram showing the supply duct manifold used in conjunction with a preferred embodiment of the present invention.
Figure 7:
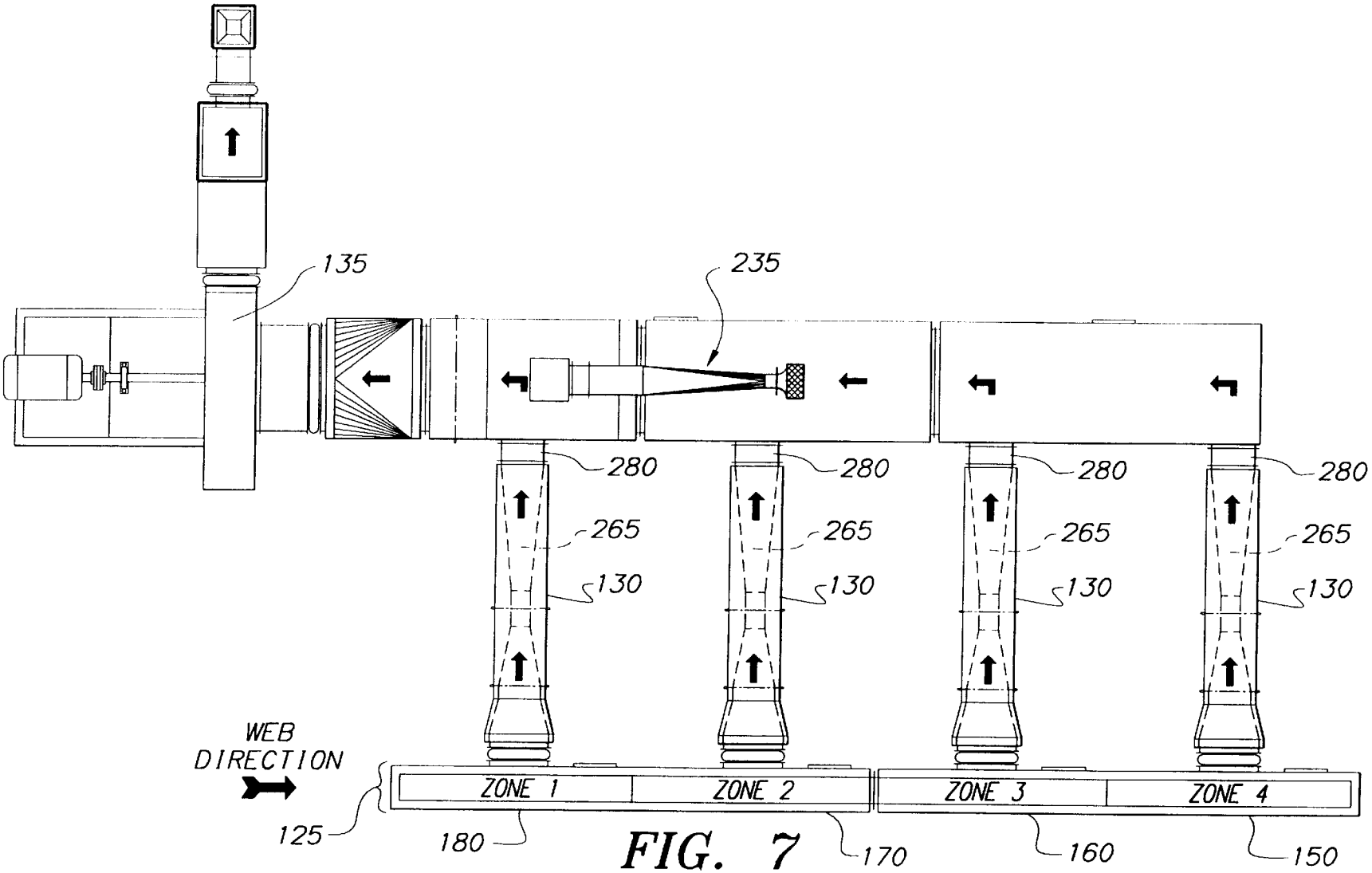
FIG. 7 is a schematic diagram showing the return duct manifold used in conjunction with a preferred embodiment of the present invention.

FIGS. 6 and 7 are schematic diagrams illustrating the supply and return duct manifolds, respectively, used in conjunction with a preferred embodiment of the present invention. Like numerals are used in these figures to identify components described previously above.

Figure 8:
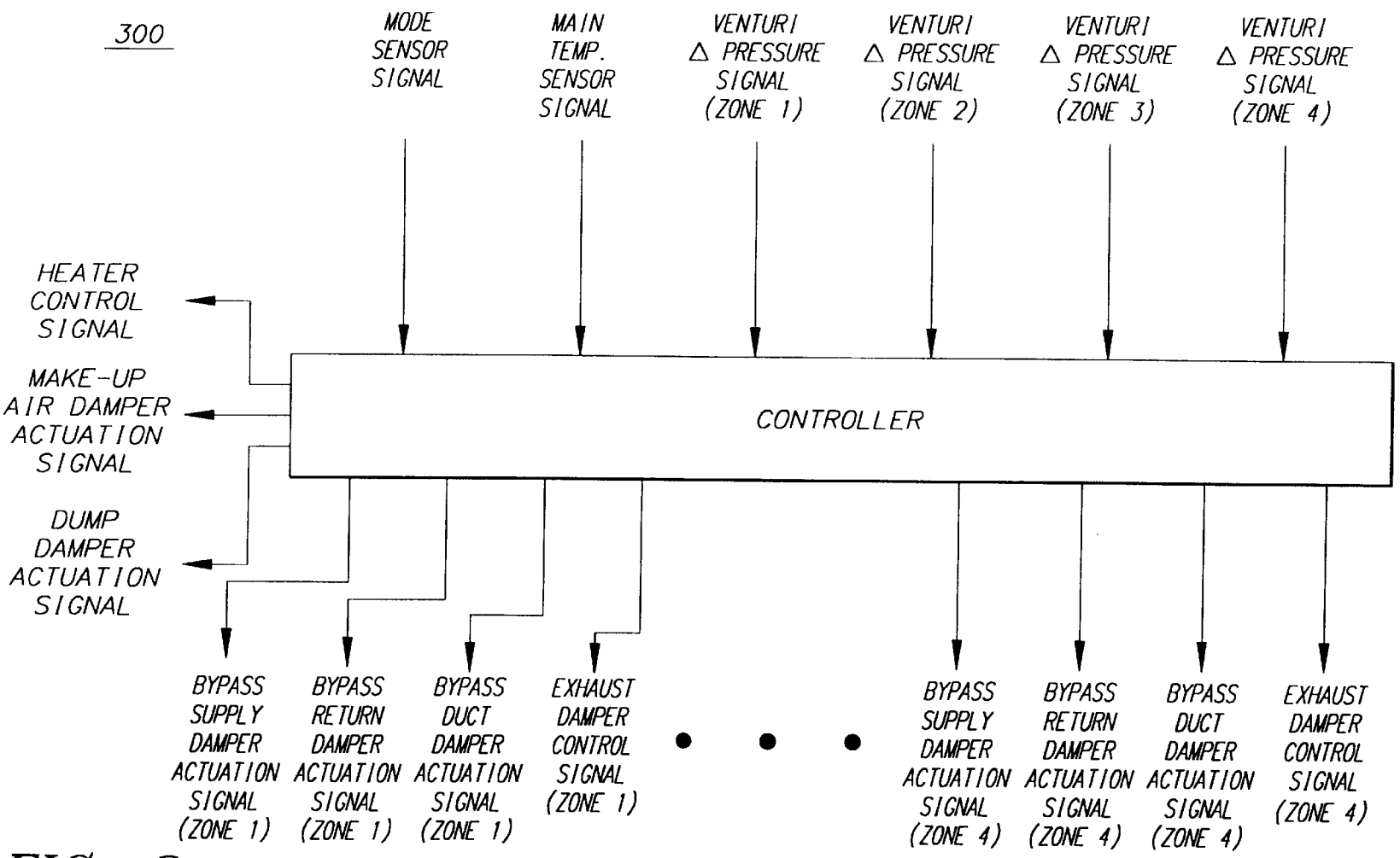
FIG. 8 is a block diagram showing a controller for controlling the operation of a convection oven system in accordance with a preferred embodiment of the present invention.

Referring now to FIG. 8, there is shown a block diagram illustrating a controller 300 for controlling the operation of a convection oven system 100 in accordance with a preferred embodiment of the present invention. As one of its inputs, controller 300 accepts an electrical mode sensor signal representing the mode (either running or bypass) in which system 100 is to operate. The mode sensor signal may be generated manually by an operator. Alternatively, when convection oven system 100 is used as part of a complete product manufacturing line, the mode sensor signal may represent an output from one or more machines in the manufacturing line indicating whether such machines are running or idle. In this embodiment, when the other machines in the manufacturing line switch from a running state to an idle state, the mode sensor signal will switch system 100 from its running mode to its bypass mode. Similarly, when the other machines in the manufacturing line switch from an idle state to a running state, the mode sensor signal will switch system 100 from its bypass mode to its running mode.

In response to the mode control signal, controller 300 generates bypass supply damper actuation control signals, bypass duct damper actuation control signals, and bypass return damper actuation control signals for controlling the actuators 210, 220 and 215, respectively, in each of the four oven zones. When the mode control signal provided to controller 300 indicates that system 100 is to operate in its running mode, the bypass supply damper actuation control signals, bypass duct damper actuation control signals, and bypass return damper actuation control signals cause the bypass supply and bypass return dampers to open, and the bypass duct damper to close. Similarly, when the mode control signal provided to controller 300 indicates that system 100 is to operate in its bypass mode, the bypass supply damper actuation control signals, bypass duct damper actuation control signals, and bypass return damper actuation control signals cause the bypass supply and bypass return dampers to close, and the bypass duct damper to open.

In the preferred embodiment of the present invention, the response time required to bring system 100 from its bypass mode back to its running mode is less than about 30 seconds. Thus, within 30 seconds of toggling from the bypass mode to the running mode, the hot air flowing over object 120 is at its target running temperature and is therefore sufficient to bond a nonwoven fiber web passing through convection oven system 100. More preferably, the response time is less than about 15 seconds, and most preferably, the response time is less than about 5 seconds. If the response time is too long, process efficiencies and waste levels may fall outside of acceptable limits. This fast response time allows the portion of a nonwoven fiber web residing within convection oven system 100 during the bypass mode to be usable (i.e., within specification) when system 100 returns to its running mode and the web begins moving again through oven system 100.

In addition to the mode sensor signal, controller 300 accepts a signal from each venturi 265 representing the change in pressure sensed across the venturi. In response to the signal from each venturi 265, controller 300 generates an exhaust damper control signal for adjusting each exhaust damper 280 in order to maintain a constant mass flow rate through each of four zones in oven system 100 as described above.

Finally, controller 300 accepts as one of its inputs the output of main temperature sensor 230. As explained more fully above, during the running mode, the output of sensor 230 is used by controller 300 to generate a heater control signal for modulating the amount of energy provided to heater 145. In the embodiment shown in FIG. 5, the heater control signal is used to modulate the amount of gas provided to heater 145 through valve 275. During the bypass mode, the output of sensor 230 is used by controller 300 to generate a makeup air damper control signal for modulating the volume of ambient air introduced into system 100 through makeup air damper 235.

Although in the preferred embodiment described above, controller 300 will switch all zones 150, 160, 170 and 180 simultaneously between the bypass and running modes in response to a change in the mode control signal, in an alternate embodiment, zone sequencing may be used to bring system 100 from the bypass mode back to the running mode. More particularly, in response to a change in the mode control signal indicating that system 100 is to switch from bypass mode to running mode, controller 300 may cause the zones 150, 160, 170 and 180 to switch from bypass mode to running mode sequentially (as opposed to simultaneously). In a preferred embodiment, controller 300 will cause zone 150 to switch first from bypass mode to running mode and, after a predetermined dwell time, zone 160 will then be switched to the running mode, and so on until all four zones are operating in the running mode.

In the preferred embodiment described above, convection oven system 100 is used in conjunction with conveyor assembly 205 which moves continuously when system 100 is in its running mode, and which is idle when system 100 is in its bypass mode. In an alternate embodiment, convection oven system 100 may be used as part of a manufacturing line that uses indexing, and which therefore repetitively starts and stops at regularly spaced time intervals. In this alternate embodiment, system 100 would remain in its running mode during the regularly spaced time intervals, and would be switched to its bypass mode when the manufacturing line remained still for periods exceeding these regular intervals.

In a still further alternative embodiment of the present invention, convection oven system 100 may be modified for cooling an object 120 by replacing heater 145 with a conventional heat exchanger that absorbs heat energy from the air circulating in system 100. In this alternative embodiment, zone 185 acts as a heat transfer zone wherein heat energy from object 120 is absorbed by the cool air circulating through the zone.

Although the preferred embodiment of the present invention as described above uses regular air as the heat transfer medium for applying either heating or cooling to object 120, it will be understood by those skilled in the art that other gases such as, for example, nitrogen, may be circulated within system 100 as the heat transfer medium used to heat or cool object 120. Depending on the chemical makeup of object 120, it may be preferable in some applications to use a gas for the heat transfer medium that is substantially free of oxygen or other components found in normal air.

The present invention may be embodied in other specific forms without departing from the spirit or essential attributes of the invention. Accordingly, reference should be made to the appended claims, rather than the foregoing specification, as indicating the scope of the invention.

What is claimed is:

1. A convection oven for applying convective heat to an object, comprising:

(A) a supply hood, a suction hood, and a heat application zone positioned between said supply hood and said suction hood for applying said convective heat to said object;

(B) a supply duct, coupled to said supply hood, for channelling said convective heat into said supply hood;

(C) a return duct, coupled to said suction hood, for channelling said convective heat out of said suction hood;

(D) a bypass duct for channelling said convective heat from said supply hood to said suction hood by bypassing said heat application zone, said bypass duct having a first end coupled to said supply hood and a second end coupled to said suction hood;

(E) a bypass supply damper positioned within said supply hood and adjacent to said first end, said bypass supply damper being alternatively positionable in either an open or closed position; and (F) a bypass suction damper positioned within said suction hood and adjacent to said second end, said bypass suction damper being alternatively positionable in either an open or closed positioned; and (G) a bypass duct damper positioned within said bypass duct, said bypass duct damper being alternatively positionable in either an open or closed position.

2. The oven of claim 1, said oven being operable in a running mode when said bypass supply damper and said bypass suction damper are both positioned in said open position and said bypass duct damper is positioned in the closed position, said oven being operable in a bypass mode when said bypass supply damper and said bypass suction damper are both positioned in said closed position and said bypass duct damper is positioned in a substantially open position.

3. The oven of claim 2, wherein said object is a continuous porous web of material, further comprising conveyor means for continually passing said porous web through said heat application zone.

4. The oven of claim 3, further comprising a plurality of heat application zones arranged in series, said conveyor means including means for sequentially passing said porous web through each of said plurality of heat application zones.

5. The oven of claim 4, further comprising zone activation means for sequentially activating said plurality of heat activation zones upon initiation of said running mode.

6. The oven of claim 5, wherein said object is a supply of discrete shaped pieces of material.

7. The oven of claim 2, wherein a hot gas circulating within said convection oven is used for applying said convective heat to said object.

8. The oven of claim 3, wherein said hot gas is heated air.

9. The oven of claim 3, wherein the supply hood further comprises a flow distributor to distribute the hot gas more uniformly in the supply hood and heat application zone.

10. A method for selectively providing convective heat to an object with a dual mode convection oven alternatively operable in either a running mode or a bypass mode, comprising the steps of:

(A) channelling said convective heat into a supply hood through a supply duct;

(B) channelling said convective heat out of a suction hood through a return duct;

(C) selecting an operating mode for said convection oven;

(D) if said selected operating mode is said running mode, then positioning a bypass supply damper in an open position, said bypass supply damper being located within said supply hood and adjacent to said first end; positioning a bypass suction damper in an open position, said bypass supply damper being located within said suction hood and adjacent to said second end; and positioning a bypass duct damper in a closed position, said bypass duct damper being located in said bypass duct to enable said convective heat to be channelled to said object from said supply hood through a heat application zone and into said suction hood, said heat application zone being positioned between said supply hood and said suction hood; and (E) if said selected operating mode is said bypass mode, then channelling said convective heat away from said heat application zone by directing said convective heat from said supply hood through a bypass duct and into said suction hood, said bypass duct having a first end coupled to said supply hood and a second end coupled to said suction hood.

11. The method of claim 10, wherein step (E) further comprises the steps of positioning said bypass supply damper in a closed position, and positioning said bypass suction damper in a closed position; and positioning the bypass duct damper in a substantially open position.

12. The method of claim 11, wherein said object is a continuous porous web of material, step (D) further comprising the step of continually passing said porous web through said heat application zone during said running mode.

13. The method of claim 12, wherein a plurality of heat application zones are arranged in series, step (D) further comprising the step of sequentially passing said porous web through each of said plurality of heat application zones.

14. The method of claim 13, step (D) further comprising the step of initiating said running mode by sequentially activating said plurality of heat application zones.

15. The method of claim 14, wherein said object is a supply of discrete shaped pieces of material.

16. The method of claim 15, wherein a hot gas circulating within said convection oven is used for providing said convective heat to said object.

17. The method of claim 13, wherein said hot gas is heated air.

18. An apparatus for applying convective head transfer to an object, comprising:

(A) a supply hood for supplying a cool gas into a heat transfer zone and a suction hood for withdrawing cool gas from said heat transfer zone, said heat transfer zone positioned between said supply hood and said suction hood for applying said heat transfer to said object;

(B) a supply duct, coupled to said supply hood, for channelling a cool gas into said supply hood;

(C) a return duct, coupled to said suction hood, for channelling said cool gas out of said suction hood; and (D) a bypass duct for channelling said cool gas from said supply hood to said suction hood by bypassing said heat transfer zone, said bypass duct having a first end coupled to said supply hood and a second end coupled to said suction hood;

(E) a bypass supply damper positioned within said supply hood and adjacent to said first end, said bypass supply damper being alternatively positionable in either an open or closed position; and (F) a bypass suction damper positioned within said suction hood and adjacent to said second end, said bypass suction damper being alternatively positionable in either an open or closed positioned; and (G) a bypass duct damper positioned within said bypass duct, said bypass duct damper being alternatively positionable in either an open or closed position;

wherein said cool gas provides said heat transfer to said object.

19. A method for selectively providing convective heat transfer to an object with a dual mode heat transfer apparatus alternatively operable in either a running mode or a bypass mode, comprising the steps of:

(A) channelling a cool gas into a supply hood through a supply duct;

(B) channelling said cool gas out of a suction hood through a return duct;

(C) selecting an operating mode for said heat transfer apparatus;

(D) if said selected operating mode is said running mode, then positioning a bypass supply damper in an open position, said bypass supply damper being located within said supply hood and adjacent to said first end; positioning a bypass suction damper in an open position, said bypass supply damper being located within said suction hood and adjacent to said second end; and positioning a bypass duct damper in a closed position, said bypass duct damper being located in said bypass duct to enable said cool gas to be channelled to said object from said supply hood through a heat transfer zone and into said suction hood, said heat transfer zone being positioned between said supply hood and said suction hood; and (E) if said selected operating mode is said bypass mode, then channelling said cool gas away from said heat transfer zone by directing said cool gas from said supply hood through a bypass duct and into said suction hood, said bypass duct having a first end coupled to said supply hood and a second end coupled to said suction hood.

* * * * *